United States Patent [19]

Johnson et al.

[11] Patent Number: 5,060,579

[45] Date of Patent: Oct. 29, 1991

[54] SLIDING HOPPER OUTLET GATE WITH PLASTIC UPPER SURFACE FOR SMOOTH SLIDING AND FOR SEALING THE OUTLET

[75] Inventors: James W. Johnson, Jackson, Tenn.; Francis R. Schultz, Woodridge, Ill.; Wayne A. Rhodes, Luray, Tenn.; Roy W. Miller, Highland, Ind.

[73] Assignee: Itel Rail Corporation, San Francisco, Calif.

[21] Appl. No.: 491,117

[22] Filed: Mar. 8, 1990

[51] Int. Cl.[5] ..... B61D 7/20; B61D 7/22

[52] U.S. Cl. ..... 105/282.1; 105/292.2

[58] Field of Search ..... 105/280, 282.1, 282.2, 105/293; 406/128, 130, 145

[56] References Cited

U.S. PATENT DOCUMENTS

| | | | |
|---|---|---|---|
| 609,816 | 8/1898 | Kramer | 105/282.1 X |
| 820,240 | 5/1906 | Muloch | 105/282.1 X |
| 1,019,875 | 5/1912 | Wright | 105/282.1 X |
| 1,360,805 | 11/1920 | Sherman et al. | 105/282.1 X |
| 2,043,615 | 6/1936 | Hankins | 105/282.1 |
| 2,915,022 | 12/1959 | Dorey | 105/282.1 |
| 3,446,538 | 5/1969 | Danielson | 105/282.2 X |
| 3,635,170 | 1/1972 | Chierici | 105/282.1 |
| 4,344,365 | 8/1982 | Fritz et al. | 105/282.1 X |
| 4,429,921 | 2/1984 | Fritz et al. | 105/282.2 X |

*Primary Examiner*—Robert J. Oberleitner
*Assistant Examiner*—S. Joseph Morano
*Attorney, Agent, or Firm*—Myers & Associates, Ltd.

[57] ABSTRACT

A hopper with a bottom discharge slot and valving comprising plates slidably supported beneath the slot and movable between closed and open positions, said plates having a plastic flexible covering to facilitate movement in shear against the load of the particulate material bearing thereagainst.

19 Claims, 6 Drawing Sheets

Fig. 7
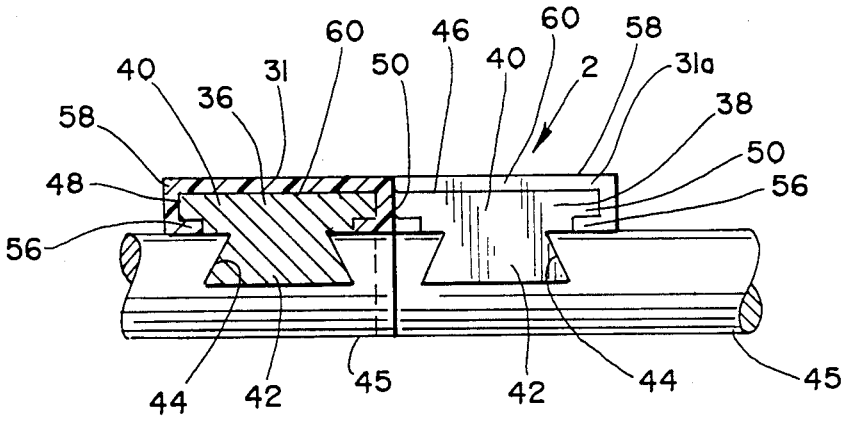
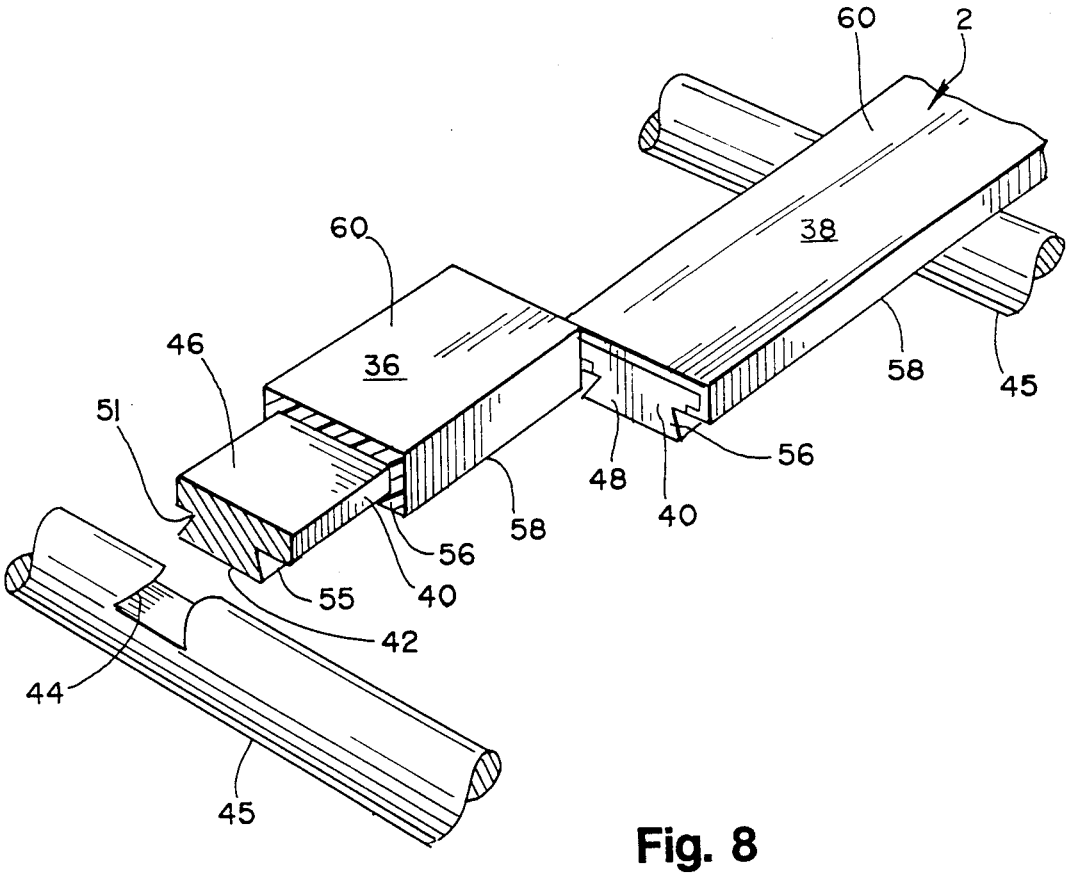
Fig. 8

SLIDING HOPPER OUTLET GATE WITH PLASTIC UPPER SURFACE FOR SMOOTH SLIDING AND FOR SEALING THE OUTLET

The invention relates to a valve or gate arrangement for hoppers of a railway car.

BACKGROUND OF THE INVENTION

This invention pertains to a mechanism used in pneumatic transfer of lading for closing and opening the discharge opening at the bottom of a hopper particularly for use with plastic pellets or granular material.

This type of material is generally difficult to discharge from containers with present type of valving comprising complex gates and operating mechanisms for closing the hopper and in discharging from the hopper. Particles of the material will bridge a portion of the discharge opening of the chute. In vacuum discharge arrangements upon malfunctioning when bridging occurs, the air is aspirated through a bypass passageway formed in the hopper alongside a static remaining pile of bridged material and flows into the discharge chute, thus preventing discharge of the material. This may cause the train personnel to climb on top of the car and poke the pile loose into the gate and thus close the bypass passageway so that the vacuum system can draw the material falling from the hopper.

In normal operation air is passed through the discharge tube at the bottom of the hopper outlet opening and the material cascading from the hopper is entrained in the air steam and drawn out from a discharge end of the tube while the air is being drawn into the other end of the tube. If the material builds up below the hoppers discharge opening, probes are used to disperse the compacted material into the air steam.

SUMMARY OF THE INVENTION

The principal object of the invention is to improve the quality of the plastic pellet outlet gate.

A further object is to design a unit of reduced weight and improve carload weight.

Another object is to provide a gate arrangement having improved unloading characteristics which affords ease of operation.

A different object is to provide a low maintenance outlet gate and one which may be repaired in the field.

Another object is to provide an operating mechanism that will not jam.

A further object is to provide an outlet gate of improved streamline appearance to reduce air drag.

The invention contemplates a gate obtaining an improved unloading rate.

The invention also comprehends a gate which can be cleaned without disassembly.

In addition the invention obtains a design of control valve which shears through the load versus opposing the load in both static and dynamic conditions. Provisions is also made for operation from the near and far sides and for product from the center of the discharge control tube to improve unloading and rate volume.

The invention also comprehends a narrow valve opening of approximately 1¾ inches to obtain the largest unloading rate in the market place.

These and other objects and advantages inherent in and encompassed by the invention will become more readily apparent from the specification and the drawings, wherein:

FIG. 7 is an enlarged fragmentary cross-section of valve assembly shown in FIG. 1.

FIG. 8 is an enlarged exploded view of the valve assembly.

DESCRIPTION OF THE INVENTION

Figure 1:
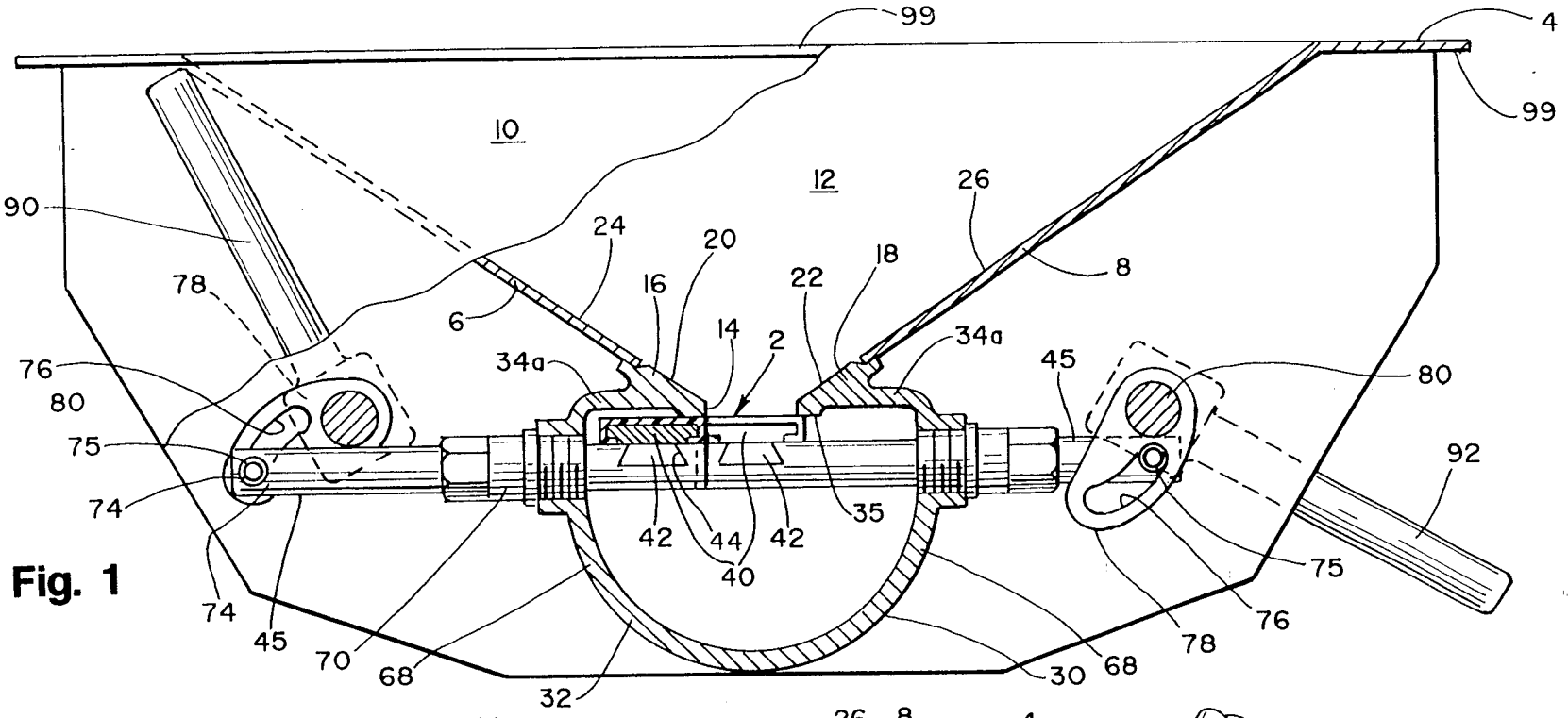
FIG. 1 is a transverse vertical sectional view of the apparatus taken substantially on line 1—1 of FIG. 6.
Figure 2:
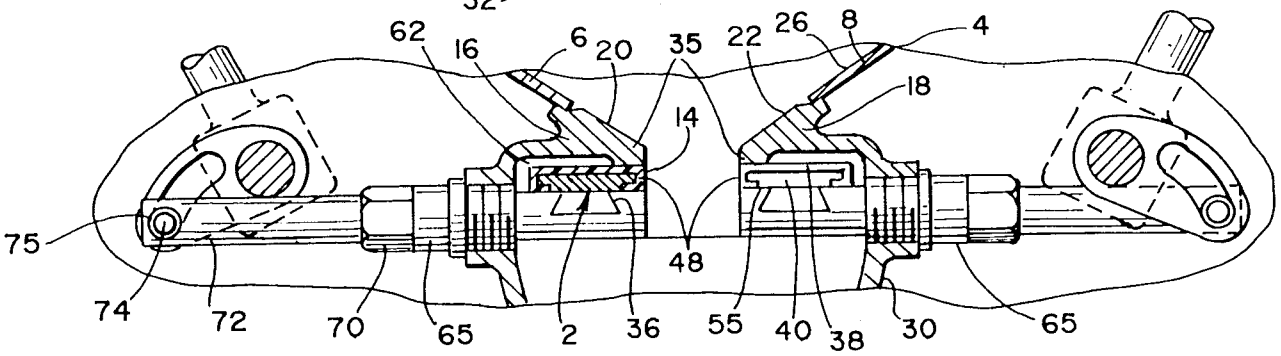
FIG. 2 is a cross-section view similar to FIG. 1 showing the valve assembly in fully open position.
Figure 3:
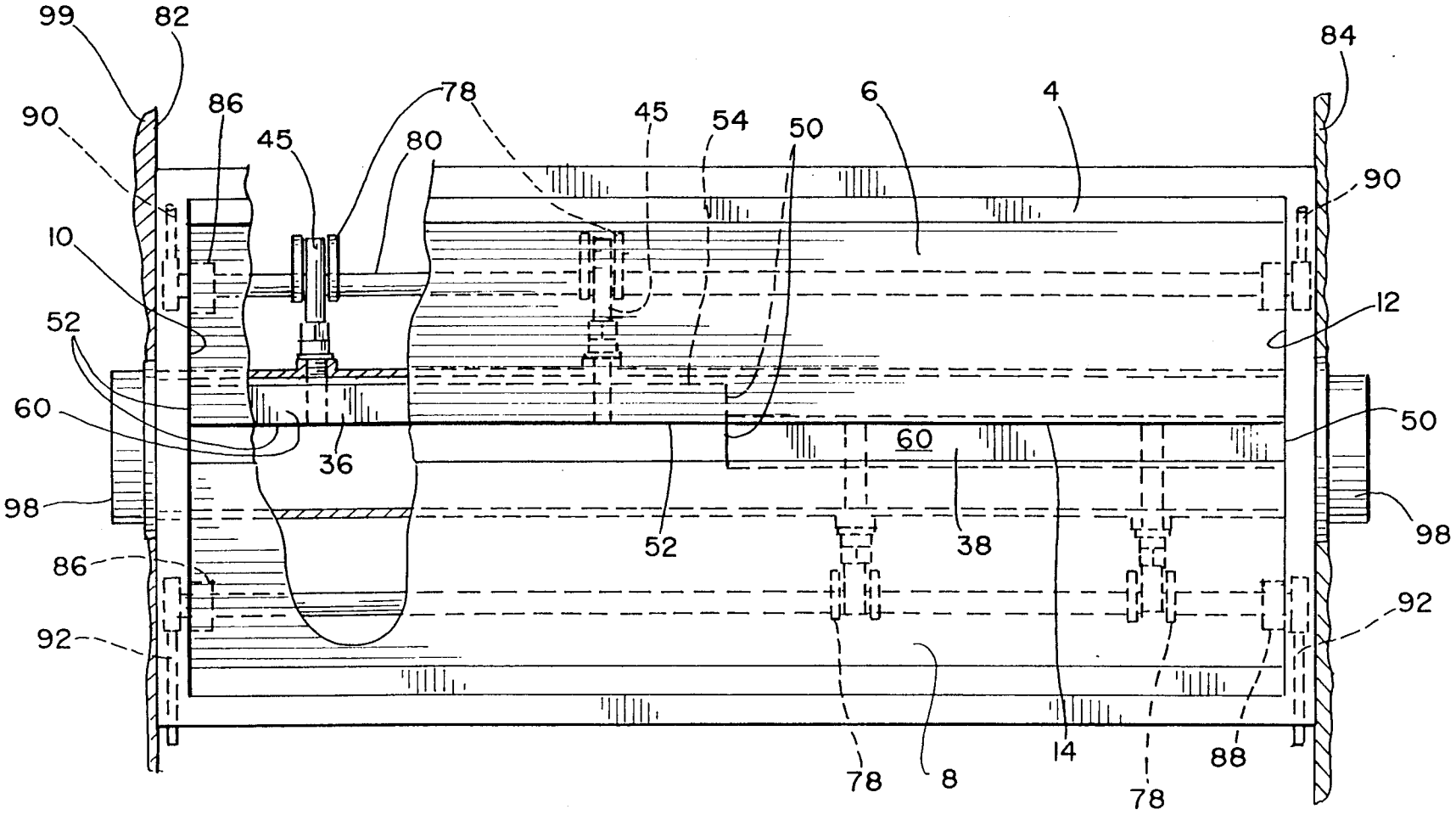
FIG. 3 is a top plan view of the hopper and valve assembly shown in partly open position.
Figure 6:
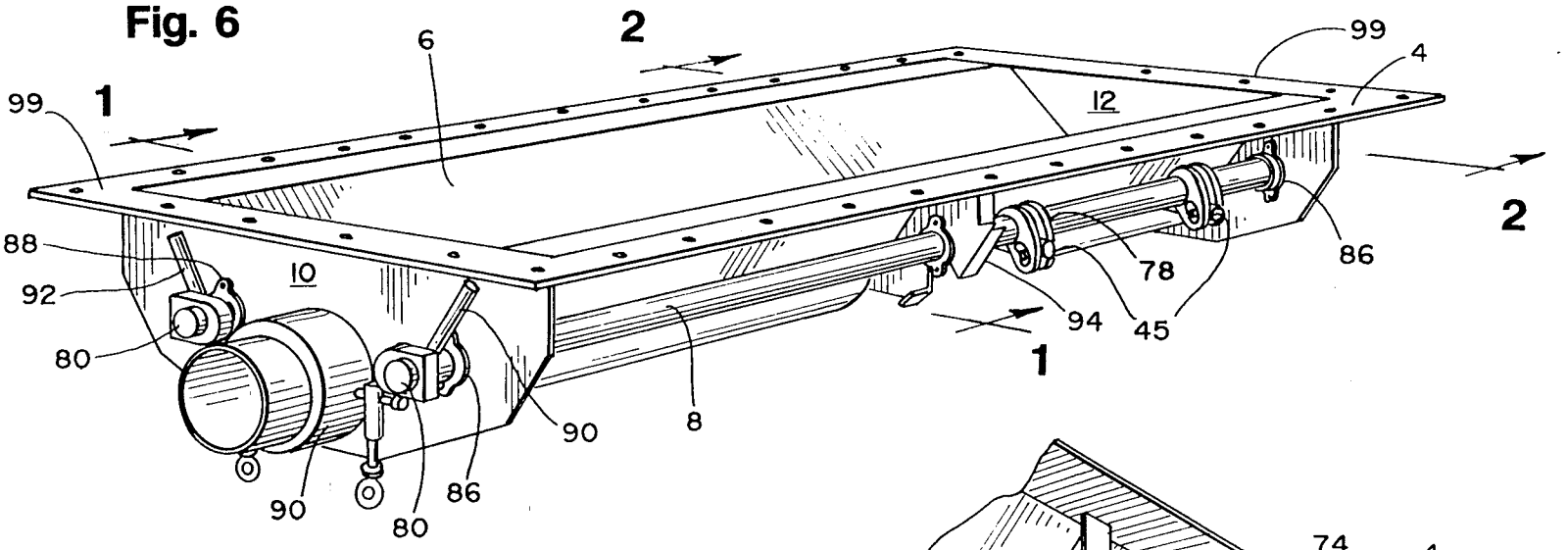
FIG. 6 is a top perspective view.
Figure 4:
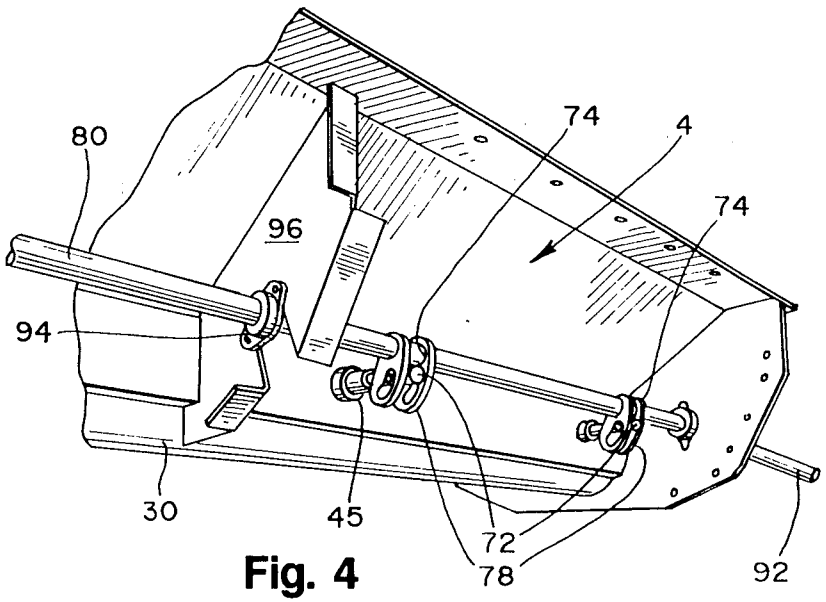
FIG. 4 is a fragmentary bottom perspective view of the assembly.

The invention of the gate assembly generally designated 2 is shown in association with a hopper 4 which is constituted of side panels 6, 8, and end panels 10 and 12 which coverge downwardly and terminate in a narrow elongated rectangular outlet 14 which spans the space between the side sheets 6, 8 and terminates at its ends at the end sheets 10, 12. The width of the outlet slot 14 is approximately 1¾ inches and is formed on its lateral sides by guides 16, 18 having downwardly sloping sides 20, 22 coplanar with the upper sides 24, 26 of the side panels or sheets 6, 8. The lower edge portions of the sheets 6, 8 may be welded or brazed or aluminum welded to the guides 16, 18 dependent the metal used, in the production of the vacuum trough or tube 30 positioned at the bottom of the hopper.

The tube 30 comprises an U-shaped body 32 having upper re-entrant flanges **34, 34*a*, which merge with the guides 16, 18**.

The guides 16, 18 are provided with bottom flat faced sealing pads **35, 35*a* which contact the upper flat faces 31, 31*a* of identical valve plate members 36, 38**.

The two valve members are arranged lengthwise end to end and extend the full length of the discharge slot and are slightly wider than the width of the discharge slot.

Each valve member 36, 38 is of rectangular shape and occupies one half of the discharge slot. Each valve member is generally flat and has a core structure 40 with a dependent bottom trapezoidal shaped key 42 which fits into complementarly shaped keyways 44 in a control rod 45. The core structure 40 is rectangular and has a top flat face 46 and has vertical end margins 48, 50, and side edges 52, 54 and a permetrical recess 51 in the bottom 55 of the core into which extend inturned flanges 56 of a cladding 58 which encompasses the four edges of the core and has a flat top plate section 60 which slidably sealably engage the flat pads 35, 35. The cladding is preferably made of plastic non-corrosive material which will resist pitting and other malformations. Material such as 90 durometer urethane or the like is preferably used which deforms slightly as the valve is slid back and forth under the load.

Each flange 34 is recessed at 62 on its bottom side to facilitate to and from movement of the valve plates with minimal friction areas concentrated at the dependent pads.

Each control rod extends laterally from the discharge slot through a packing gland 65 pressed within a cylindrical tube or boss 66 formed adjacent to the upper portion of each upright section 68 of the discharge chute. Bearings 70, extend axially outwardly from the respective support stubs or bosses into which they are pressed and are sleeved about the associated control rod 45 which at its distal end 72 is provided with a transverse pin 74 journaling a follower roller 75 which is guided within an arcuate cam profile or slot 76 of a cam member 78.

There are two cams and two control rod assemblies for each valve plate.

The bearings 70 do not require lubrication and the advantage here is that it prevents lubricating materials from entering the discharge tube and contaminating a load of plastics. This means less chance of the car being rejected for an unclean gate which could contaminate lading.

Two cams are secured to each operating shaft 80, one shaft 80 is on one side of the hopper and the other shaft is on the other side. The operating shafts 80 are arranged in contact with the control rods 45 to help the bearings 70 resist upward radial thrust when the hopper load is applied to control valve surface 60. This maintains a small gap between 60, 35 and 35*a*. The shafts are parallel with each other.

Figure 5:
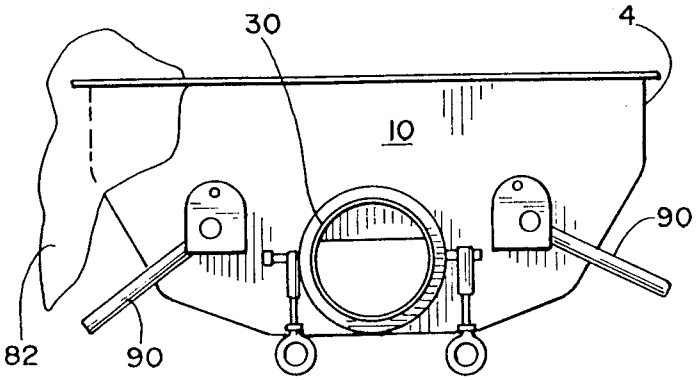
FIG. 5 is an end view.
Figure 9:
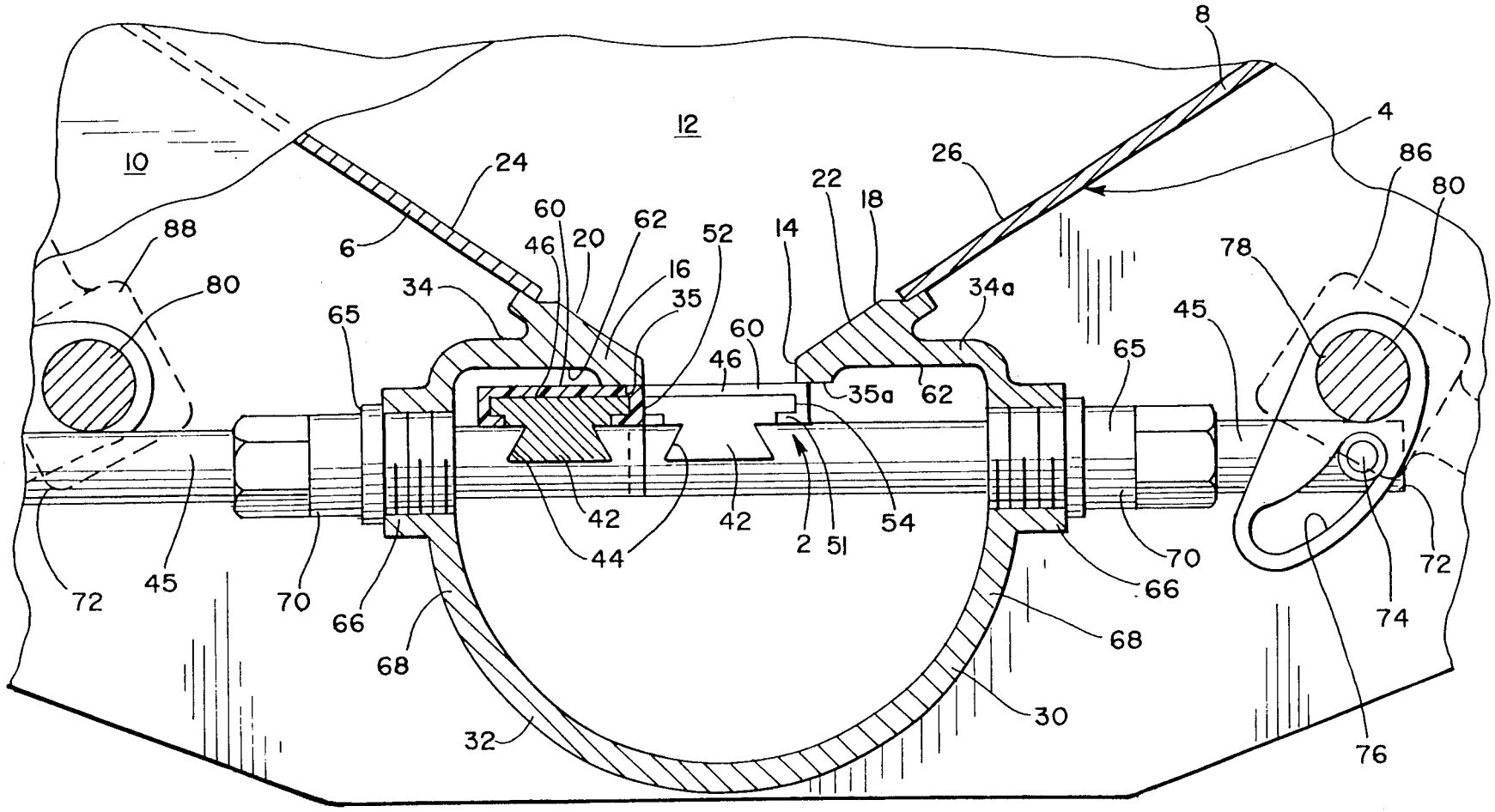
FIG. 9 is an enlarged cross-section of the structure shown in FIG. 1.
Figure 10:
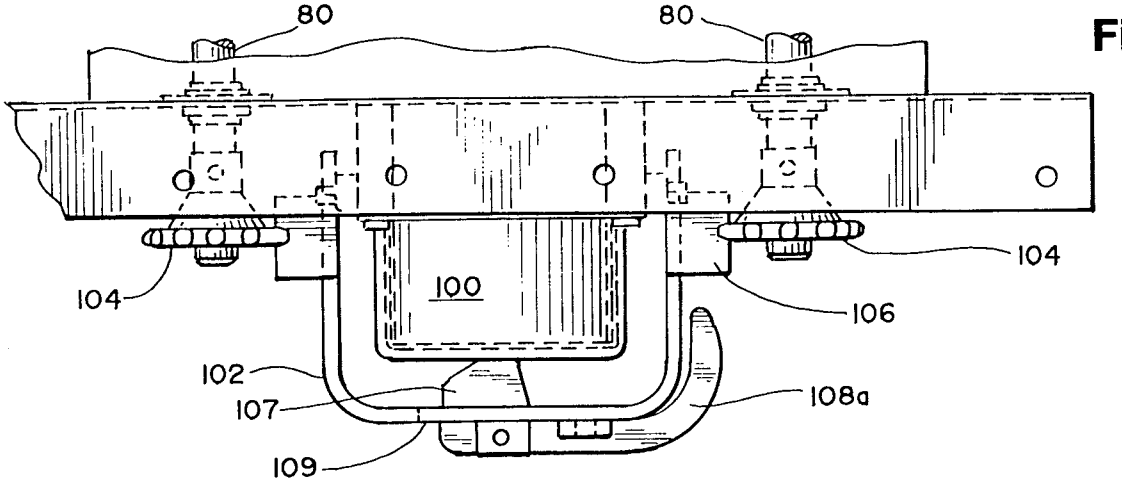
FIG. 10 is a fragmentary top view of the end cap assembly.
Figure 12:
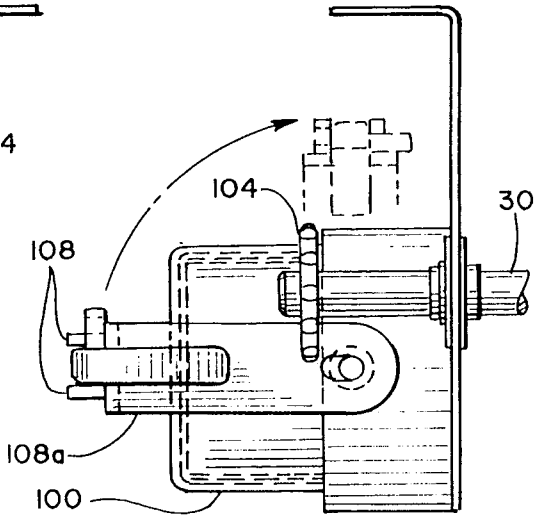
FIG. 12 is a fragmentary side view.
Figure 11:
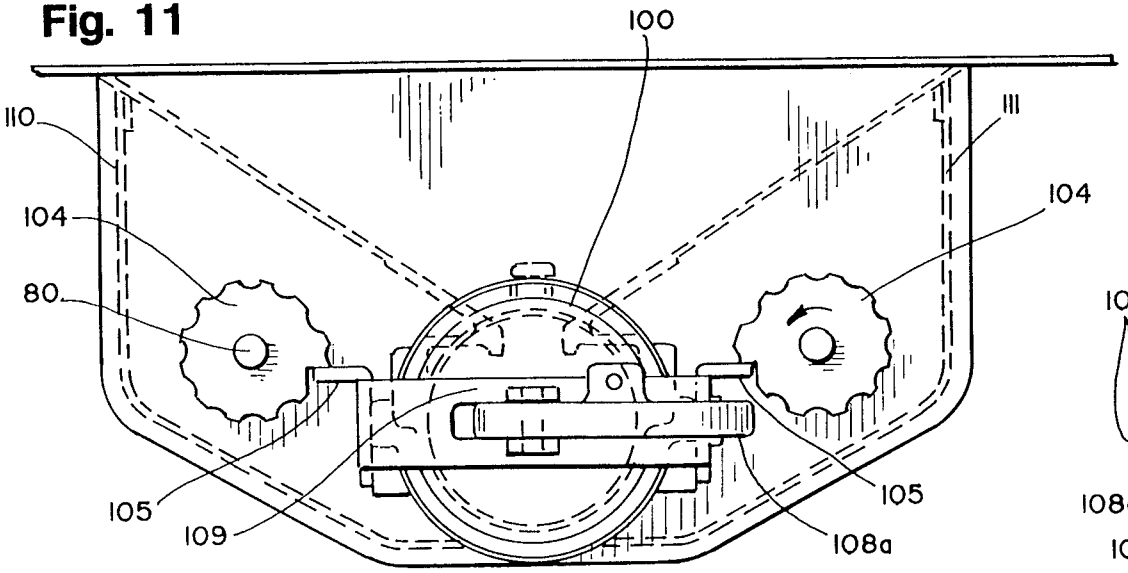
FIG. 11 is an end view.

Flanking each end of the hopper are end plates 10, 12 and are connected to the rail car structure as shown at 82 of FIG. 5 which are secured to the hopper structure at flanges 4 and 6 for integration with the railway car, a portion of which is fragmentarily shown at 82 and as is well known in the art such as in U.S. Pat. Nos. 3,637,262, 3,632,174, 3,527,503 and 3,742,865 which are incorporated by reference herein.

The shafts are mounted adjacent to each end in bearings 86, 88 which are carried by the end walls 10, 12. The outer ends of the shafts 80, 80 are connected to handles 90, 92 for rotating the same. It will be noted that a handle is provided at each end of each operating shaft 80 so that each shaft is operable from either end.

Each shaft 80 is supported intermediate its ends in a split race bearing 94 mounted to a reinforcing plate bracket 96 secured to the underside of an associated slope sheet and depending therefrom. These bearings do not require lubrication and are therefore maintenance free.

Rotating the operating shafts advances or retract the the associated valve plate to close or open the respective portion of the hopper discharge slot.

The chute has a tube 30 connected at either end to a conduit (not shown) of a vacuum discharge system well known to the art whereby the cascading load in the hopper as it descends into the chute is aspirated from the chute. As soon as the portion of the load in vertical alignment with the open valve is exhausted, the related valve is closed and the second valve is opened and the portion aligned with the second valve descends into the chute and is ported through the discharge system.

The end plates may be provided at their upper ends with outturned flanges 99 for mounting on the support structure of a railway car. It will be understood that normally one end of the discharge slot is closed when the other is connected to the vacuum discharge system.

It will be noted that the side panels 110 and 111 protect and streamline the outer shell of the hopper.

Each end of the discharge tube is provided with an end closure or cap 100 and securing bail assembly 102 somewhat similar to that shown in U.S. Pat. No. 3,700,143 which is incorporated by reference herein.

Operating heads 104 may be provided at the ends of the shafts in lieu of the handles 90, 92 and the heads may be provided with peripheral stops 105 for contact with stop legs 106 in the bail legs 108 which carries a hand operated cam 107 engaging the cap when in closed position. The cam 107 is operated by a handle 108*a* pivoted to the bight position 109 of the bail. By dropping the bail the stops 105, 106 disengage and the heads are free to be rotated. The cap may be removed. In operation, the end caps or closures are removed. One end of the trough is open to the atmosphere and the other end is connected to a vacuum discharge device. The gates are opened as required to discharge the particles through the outlet slot at the bottom of the hopper. The product or material drops gravitationally into the air stream moving from the inlet end of the tube longitudinally thereof and entrains the cascading particles and delivers it to the other end of the tube to discharge mechanism connected thereto.

What is claimed is:

1. For use in a railway car, a hopper assembly for carrying a load of particulate material, said hopper assembly having portions defining a bottom discharge slot;

a valve assembly supported beneath the hopper assembly and comprising;

a flat plate slidably mounted beneath the slot for movement edgewise horizontally between closed and open positions in tight slidable engagement with said portions, said plate comprising a top cladding of flexible plastic material for the full length and width of the plate in slidable contact in shear with said portions during the entire extent of movement from closure to opening for sealing said hopper assembly.

2. The invention according to claim 1, and said slot having an elongated conformation, and said valve assembly comprising a plurality plate segments disposed in end to end relation and individually slidable laterally with respect to the slot.

3. The invention according to claim 2, and said plates being movable in opposite directions between closed and open positions.

4. The invention according to claim 2, and a control rod extending transversely of said slot and having an inner end connected to an associated one of said plates, and means slidably mounting the control rod intermediate its ends, said rod supporting said plate.

5. The invention according to claim 4, a discharge chute positioned beneath the slot for receiving said material therefrom upon opening of either of said valve plates, and a vacuum discharge system connected to said chute.

6. The invention according to claim 1, and said valve assembly comprising a plurality of plates disposed in end to end relation and slidable in opposite directions for covering and uncovering said slot; and means for actuating said plates disposed at opposite sides of the hopper.

7. A hopper for granular particulate having a portion defining a rectangular bottom discharge outlet;

gate means disposed in movable relation to the hopper for closing and opening said discharge outlet;

said gate means comprising a pair of closure portions in edge contact with each other and slidable to each other and together spanning in closed position the entire extent of said discharge outlet;

said closure portions being movable in opposite closing and opening direction;

each portion having a flexible plastic upper face in slidable engagement with the marginal portions of said outlet for sealing the outlet;

and operating means for respective portions disposed at opposite side of the hopper, said plates being entirely flat and in closing position bearing against opposing marginal portions.

8. The invention according to claim 7, and said operating means comprising control members connected with respective portions.

9. The invention according to claim 8, and cam means associated with each control member, and means for actuating said cam means to move the respective closure portions.

10. The invention according to claim 9, and said actuating means comprising shafts rotatively mounted at opposite sides of the hopper and connected to respective cam means, said shafts extending beyond opposite ends of the hopper, and handle means on each end of each shaft adapted for manipulation for rotating the respective shafts from each end of the hopper.

11. The invention according to claim 10, and each said cam means comprising a member mounted on each respective shaft and having an arcuate profile extending eccentrically with respect to the rotational axis of the shaft and a follower on each control rod in guided engagement with respective cam.

12. The invention according to claim 1, and said valve plate having a flexible plastic covering for deflection under load.

13. The invention according to claim 12, and said plastic being of approximately 90 durometer.

14. The invention according to claim 13, and said plastic being urethane.

15. A hopper for carrying a load of particulate having an elongate outlet slot, a pair of plates extending in end to end relation across the slot in sealing relation thereto and movable coplanarly edgewise between open and closed positions, each plate having an upper face and having a plastic surface of flexible material across the upper face thereof for engaging the load in the hopper and butting into sealing engagement with marginal portions of the hopper about the slot.

16. The invention according to claim 15, and wherein said plates are movable independently of each other.

17. The invention according to claim 15, wherein said slot is defined by portions of the hopper having dependent sealing pads engagable with the top sides of said plates.

18. The invention according to claim 15, and means supporting said plates at opposite ends.

19. The invention according to claim 18, and wherein said support means comprise operating rods connected to respective plates and movable laterally thereof.

* * * * *